United States Patent [19]

Rubbo et al.

[11] Patent Number: 5,044,433

[45] Date of Patent: Sep. 3, 1991

[54] PACK-OFF WELL APPARATUS WITH STRAIGHT SHEAR RELEASE

[75] Inventors: Richard P. Rubbo, The Woodlands; Mike A. Luke, Pasadena; Brett Bouldin; Frank X. Mooney, both of Friendswood, all of Tex.

[73] Assignee: Baker Hughes Incorporated, Houston, Tex.

[21] Appl. No.: 574,279

[22] Filed: Aug. 28, 1990

[51] Int. Cl.[5] ..... E21B 33/128; E21B 23/06

[52] U.S. Cl. ..... 166/120; 166/134

[58] Field of Search ..... 166/120, 134, 387; 285/145, 146

[56] References Cited

U.S. PATENT DOCUMENTS

| | | | |
|---|---|---|---|
| 4,263,968 | 4/1981 | Garner, Jr. | 166/120 |
| 4,311,195 | 1/1982 | Mullins, II | 166/120 |
| 4,432,417 | 2/1984 | Bowyer | 166/120 |
| 4,437,516 | 3/1984 | Cockrell | 166/120 |
| 4,512,399 | 4/1985 | Gano et al. | 166/120 |
| 4,688,634 | 8/1987 | Lustig et al. | 166/120 |
| 4,711,326 | 12/1987 | Baugh et al. | 188/67 |
| 4,862,957 | 9/1989 | Scranton | 166/51 |

OTHER PUBLICATIONS

Baker Oil Tools Safety Systems Catalog, Mar. 1989, pp. 40 and 41.

*Primary Examiner*—William P. Neuder

*Attorney, Agent, or Firm*—Charles D. Gunter, Jr.

[57] ABSTRACT

A pack-off tubing hanger is shown for use in a tubing string extending from a well surface location to a downhole location within a well casing. The hanger body includes an external packing element and gripping slips which support the hanger body within the surrounding casing. A hydraulic line communicates hydraulic pressure from the lower end of the hanger to a setting chamber to hydraulically set the packing elements and actuate the gripping slips. The tubing hanger is releasable by a straight upward pull upon the tubing string extending from the well surface to the tubing hanger.

11 Claims, 6 Drawing Sheets

PACK-OFF WELL APPARATUS WITH STRAIGHT SHEAR RELEASE

BACKGROUND OF THE INVENTION

1. Field of the Invention:

The present invention relates to well devices employed in the completion and production of oil and gas wells. More specifically, the invention relates to a well tubing hanger which is retrievably anchored in a subsurface location within a well casing or other well conduit and which is releasable by a straight pull on the tubing string extending from the well surface.

2. Description of the Prior Art:

Anchor-seal assemblies of various types have been used in the past in well working operations, and in the production of a well. For instance, seal assemblies in the form of packers are known for isolating formations for treatment, or for isolating segments of liners or well casings. Packers are routinely used for sealing production strings to well liners or well casings to define flow paths from producing formations to the well surface.

Particularly in the case of packers, the seal assembly is usually positioned within a well by means of a pipe string, and then set in sealing and anchoring engagement with the surrounding conduit. The setting operation usually involves the movement of multiple components of the packer to expand one or more resilient seal members, and to wedge anchoring slips against the surrounding well conduit or casing.

In order to release the packer, it was often necessary to manipulate the pipe string leading to the well surface in various ways such as rotating or setting down weight on the pipe string. In other cases, it was necessary to run a separate release tool down the pipe string to the packer in order to release the packer.

In spite of advances in the art, a need exists for a pack-off well apparatus which is adapted for specific, demanding environments.

A need also exists for such a pack-off apparatus which can be released from the set position and retrieved to the well surface by a straight pull on the pipe string extending from the well surface to the packer.

A need also exists for a pack-off well apparatus, such as a tubing hanger, which eliminates flow ports in the production tubing or work string, or a component in direct fluid communication therewith, of the type used to provide actuating fluid from the bore of the production tubing to well tools to initiate desired operations, such as the setting of the packing element. Seals employed with such ports must be sealed in subsequent operations and are subject to deterioration and hence leakage.

The above noted needs are met by the apparatus described in the specification which follows.

SUMMARY OF THE INVENTION

The pack-off apparatus of the invention is designed for sealing between concentric tubular bodies in a subsurface well location. In its preferred form, the apparatus of the invention comprises a pack-off tubing hanger designed to support a tubing string extending from a well surface location to a downhole location within a surrounding subterranean formation lined with a well casing. The tubing hanger includes a generally cylindrical hanger body having an upper end and a lower end, the hanger body being adapted to be supported in the surrounding well casing. The hanger body has a longitudinal axis and an internal bore.

Preferably, the hanger body includes an upper cylindrical extent having a region of greater relative external diameter connected to a region of lesser relative external diameter, the region of lesser relative external diameter being received within the internal bore of the hanger body in slip-fit fashion.

A seal member is located between the region of lesser relative diameter of the upper cylindrical extent and the internal bore of the hanger body.

An inner mandrel is located within the internal bore of the hanger body. The inner mandrel is spaced apart from the hanger body to define an annular space within the internal bore of the hanger body.

An annular packing element is carried about the hanger body which is radially expandable under axial compression. A setting sleeve is carried about the hanger body. The setting sleeve is axially moveable with respect to the packing element for compressing the packing element. The setting sleeve has an upper end adapted to contact the packing element and has a lower end, the lower end of the setting sleeve being slidably received within the interior of a circumscribing member which defines a setting chamber on the exterior of the hanger body.

A plurality of circumferentially spaced slips are carried by a slip assembly on the exterior of the hanger body. The slips have outer gripping surfaces adapted to grip the surrounding well casing. The slips are actuable by axial movement of the setting sleeve to grip the well casing and support the hanger body within the well casing. A hydraulic line is provided for communicating hydraulic pressure to the setting chamber, the hydraulic line being located within the internal bore of the hanger body and being arranged to extend from a point below the circumferentially spaced slips along the longitudinal axis of the hanger body to the setting chamber, whereby the packing element and gripping slips can be set by the application of hydraulic pressure from the lower end of the hanger body.

Preferably, a second hydraulic line extends from the upper end of the hanger body to the setting chamber, whereby the packing element and gripping slips can be set by the application of hydraulic pressure from the upper end of the hanger body.

The slip assembly includes a downwardly extending cylindrical member having an internal thread profile. The hanger body is provided with a downwardly extending latch collet, the latch collet having a plurality of externally threaded collet fingers which are adapted to engage the internal thread profile provided in the downwardly extending cylindrical member. A release sleeve is located in the annular space between the inner mandrel and the hanger body, the release sleeve being provided with a plurality of external support lands which underlie the externally threaded collet fingers in an engaged position and which are axially shiftable from beneath the externally threaded collet fingers in a release position.

An actuating sleeve is carried by the inner mandrel and is axially slidable in the direction of the release sleeve upon upward movement of the inner mandrel. Shear means initially connect the actuating sleeve to the downwardly extending cylindrical member. Upward movement of the inner mandrel shears the shear means and frees the release sleeve to move the external support lands from beneath the externally threaded collet fingers to relax the packing element and gripping slips.

Additional objects, features and advantages will be apparent in the written description which follows.

DETAILED DESCRIPTION OF THE INVENTION

Figure 1:
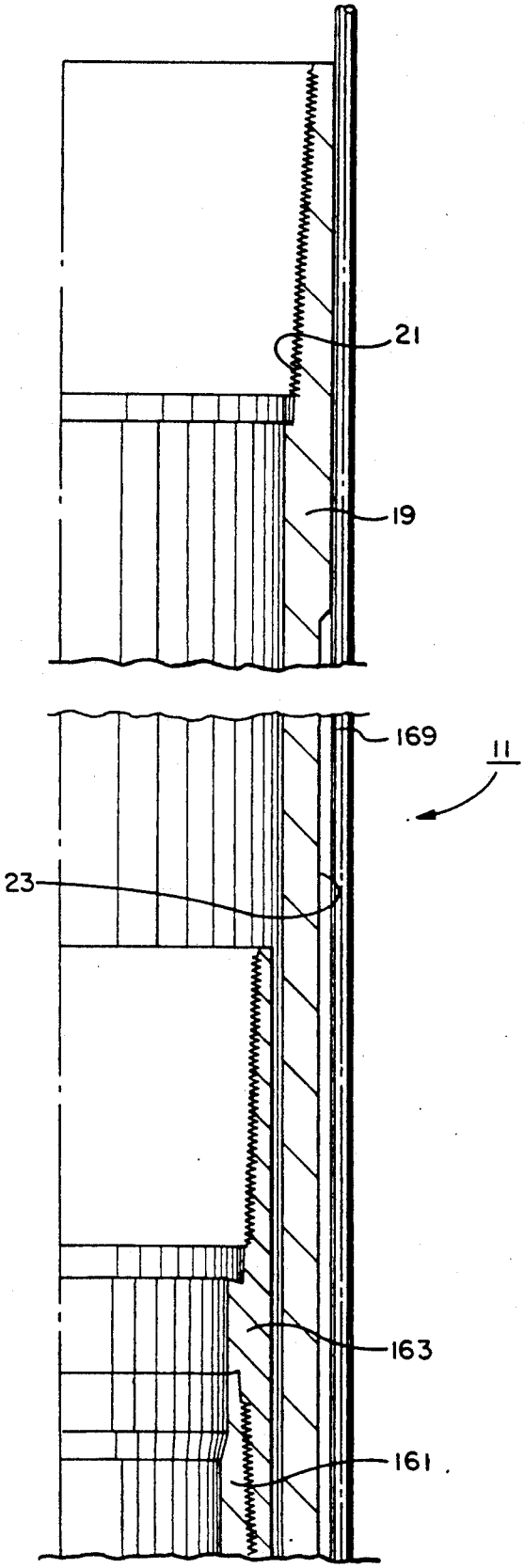
FIG. 1 is a quarter-sectional view of the upper most end of the pack-off well apparatus of the invention showing the inner mandrel received within the internal bore thereof.
Figure 7:
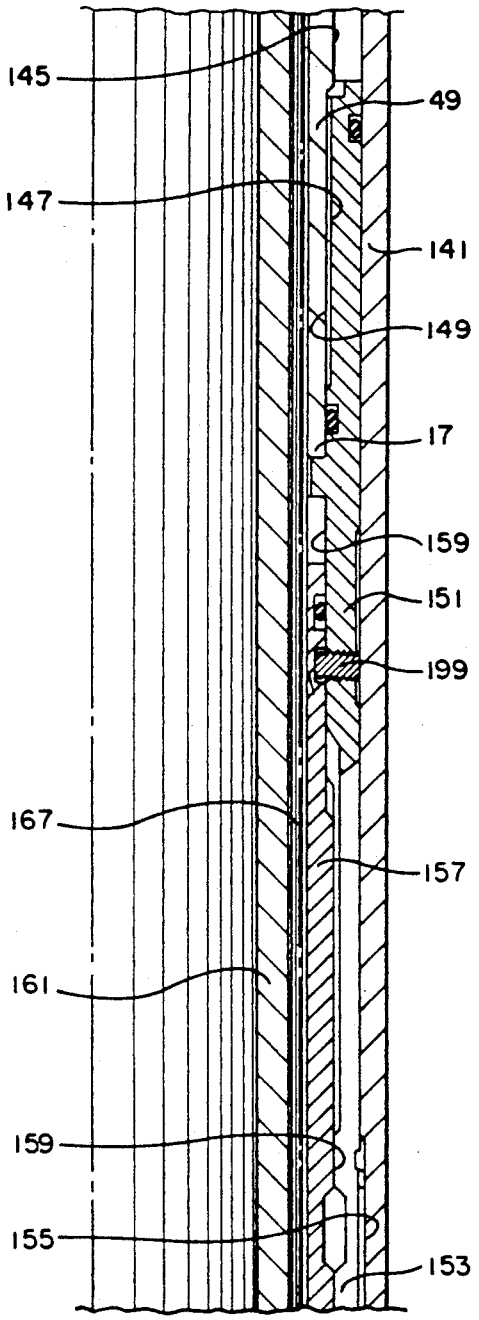
FIG. 7 is a downward continuation of FIG. 6 showing the release sleeve used during the retrieval of the tubing hanger to the well surface.

FIG. 1 shows the upper most end of a pack-off tubing hanger of the invention designated generally as 11. The tubing hanger 11 is used for supporting a tubing string extending from a well surface location to a downhole location within a surrounding subterranean formation lined with a well casing (not shown). The tubing hanger includes a generally cylindrical hanger body portion 13 (FIG. 2) which has an upper end 15 and a lower end 17 (FIG. 7). As will be described, the hanger body includes a plurality of tubular portions which are threadedly engaged between the upper end 15 and lower end 17.

Figure 2:
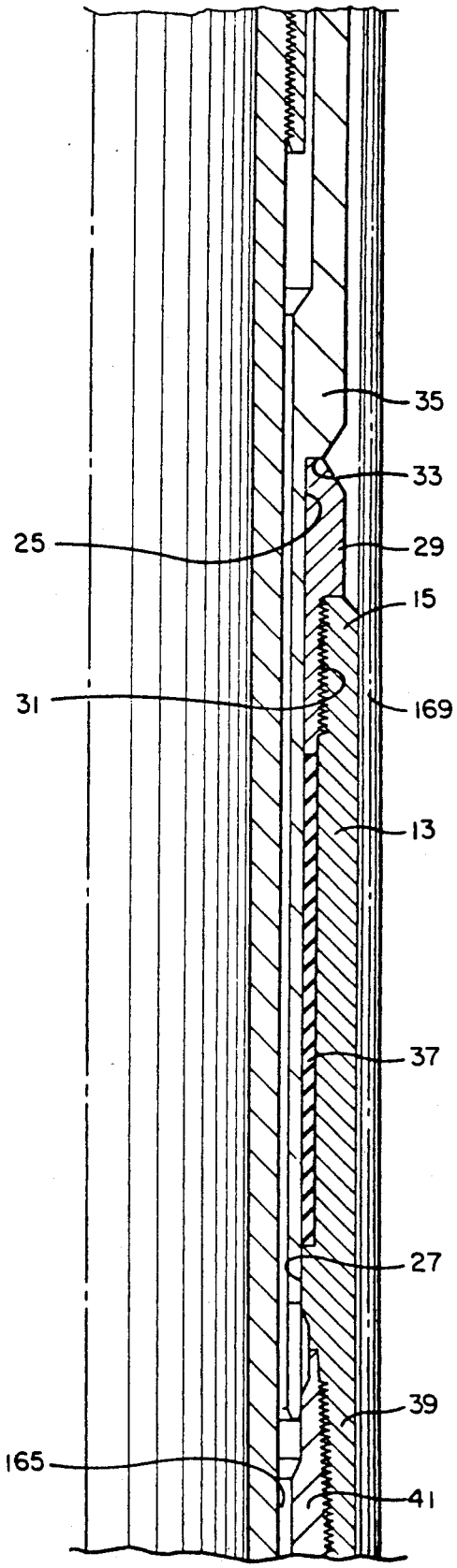
FIG. 2 is a downward continuation of FIG. 1 showing the seal member included in the slip-fit region of the upper end of the hanger body.

As shown in FIGS. 1 and 2, the generally cylindrical hanger body portion 13 includes an upper cylindrical extent 19 having a box connection 21 and a region of greater relative external diameter 23 which is connected to a region of lesser relative external diameter 25 (FIG. 2) which is adapted to be received within the internal bore 27 of the hanger body in slip-fit fashion.

A shoulder member 29 having a lower, externally threaded extent 31 matingly engages the internally threaded upper extent of the hanger body portion 13. In the position shown in FIG. 2, the shoulder member 29 locates against a mating shoulder 33 provided in the slip-fit member 35. It will be understood that members 29 and 35 may be spaced-apart, as well, in order to accommodate manufacturing tolerances when the device is assembled.

A seal member 37 is located between the region of lesser relative diameter of the slip-fit member 35 and the internal bore 27 of the hanger body 13 in order to provide a sliding seal between the slip fit member 35 and the hanger body portion 13.

Figure 3:
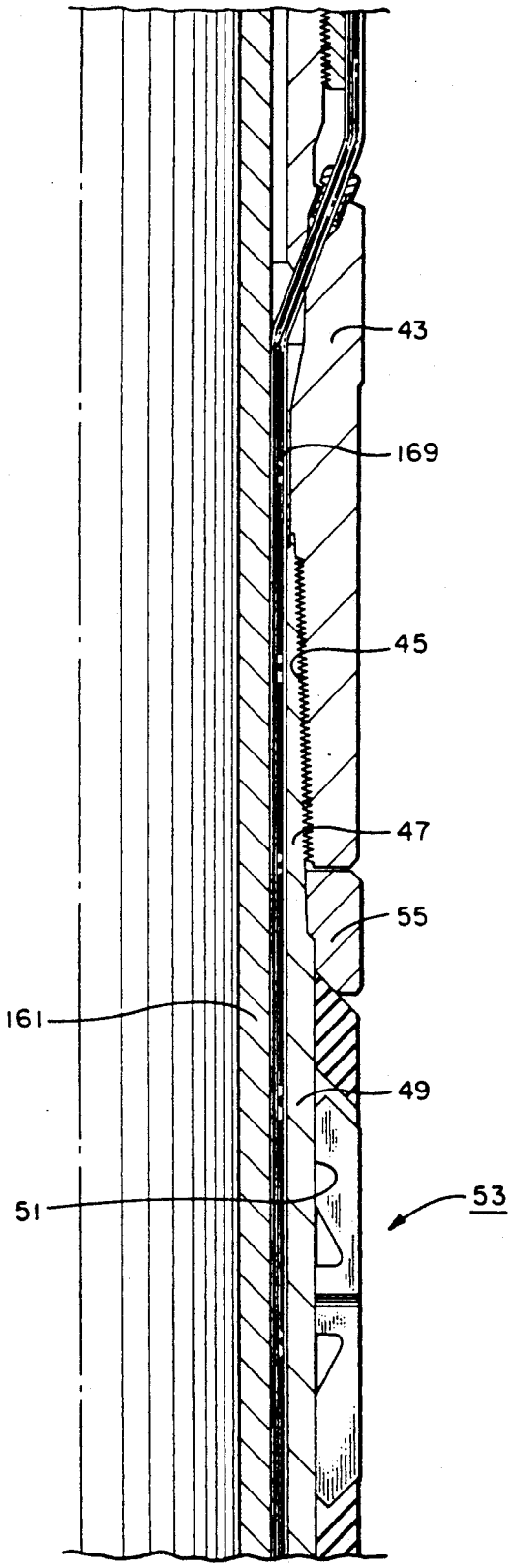
FIG. 3 is a downward continuation of FIG. 2 showing the packing element located on the exterior of the tubing hanger.

The hanger body portion 13 has an internally threaded lower extent 39 which matingly engages the externally threaded portion 41 of a depending member 43 of the hanger body. The depending member 43, as shown in FIG. 3, has an internally threaded lower end 45 for engaging the externally threaded upper extent 47 of a generally cylindrical hanger body portion 49.

The cylindrical hanger body portion 49 includes an outer region 51 which receives an annular packing element 53. The annular packing element 53 will be familiar to those skilled in the art and includes one or more elastomeric regions which are radially expandable under axial compression. The packing element 53 is expanded outwardly between an upper shoulder ring 55 fixed in position by the depending member 43 and the lower shoulder region 57 (FIG. 4) of a setting sleeve 59 which is carried about the external diameter 61 of the cylindrical hanger body portion 49.

Figure 4:
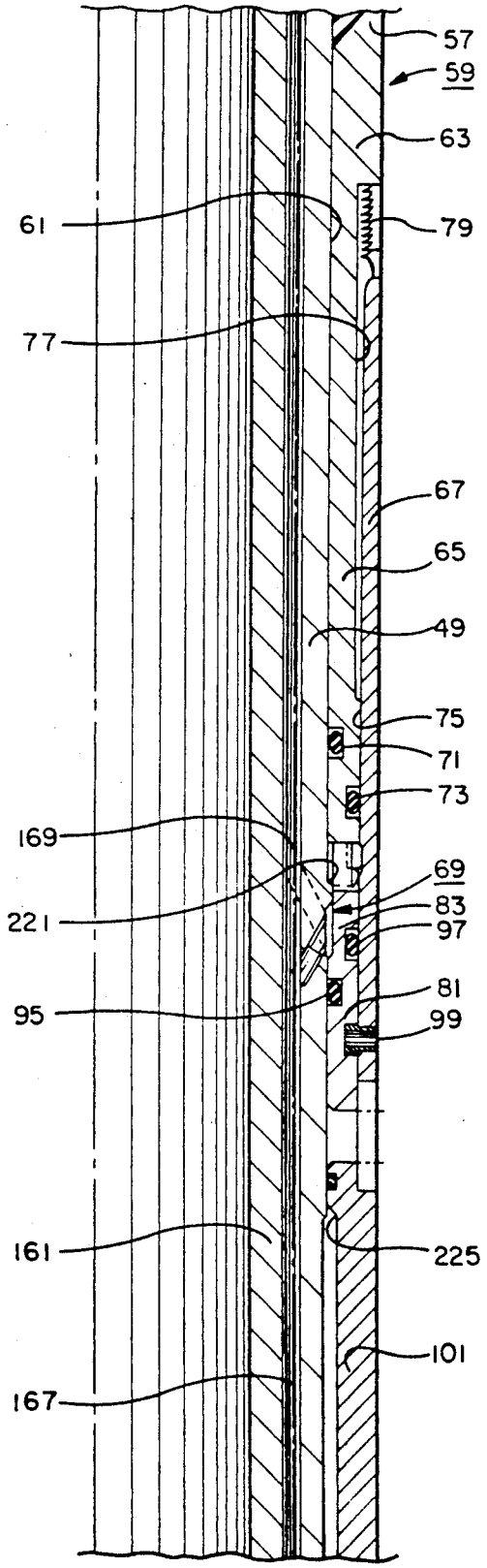
FIG. 4 is a downward continuation of FIG. 3 showing the setting chamber and setting sleeve used to set the packing element.

The setting sleeve 59 includes an upper region 63 of relatively greater external diameter and a lower region 65 of lesser relative external diameter which circumscribes the cylindrical body portion 49. The setting sleeve 59 thus has an upper end which includes the lower shoulder region 57 which contacts the packing element 53 and has a lower end region 65 which is slidably received within the interior of a circumscribing member 67 which defines a setting chamber 69 on the exterior of the hanger body. As shown in FIG. 4, O-ring seals 71, 73 are provided in mating grooves on the interior and exterior, respectively, of the setting sleeve lower end region 65 for sealingly engaging the internal diameter 75 of the circumscribing member 67 and the external diameter 61 of the body portion 49, respectively. The lower end region 65 of the setting sleeves 59 also has a ratchet region 77 on the exterior thereof for engaging a body lock ring 79 which allows upward movement of the setting sleeve 59, as viewed in FIG. 4, but which prohibits downward movement of the setting sleeve 59 after the ratchet region 77 has engaged the teeth of the body lock ring 79.

An anti-preset piston 81 is carried about the hanger body portion 49 below the setting sleeve 59, the anti-preset piston 81 having an engagement end 83 which initially locks the setting sleeve in a running-in position. The anti-preset piston is axially moveable in an opposite direction from the setting sleeve 59 to release the setting sleeve and set the packing element upon the application of hydraulic pressure to the setting chamber 69.

Figure 13:
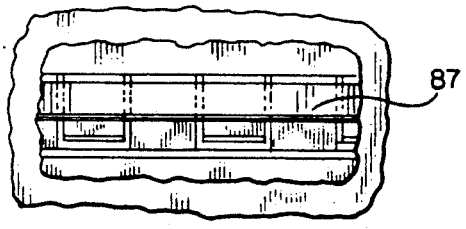
FIG. 13 is an isolated, top view of the engagement means initially used to engage the anti-preset piston with the setting sleeve in the running-in position.
Figure 14:
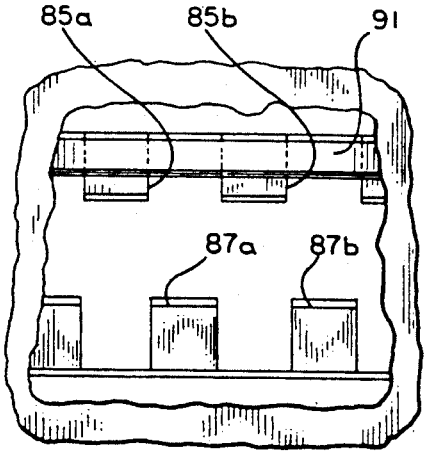
FIG. 14 is a view similar to FIG. 13 showing the separation of the anti-preset piston as hydraulic pressure is applied to the setting chamber.
Figure 15:
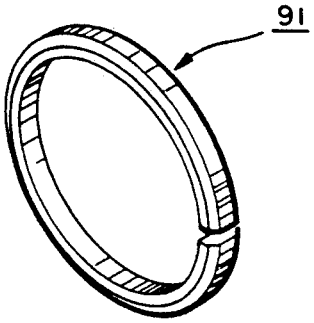
FIG. 15 is an isolated, perspective view of the snap ring which is used to initially engage the setting sleeve with the anti-preset piston.

Preferably, the setting sleeve lower end region 65 is provided with a plurality of downwardly extending fingers 85 which define circumferentially spaced end slots 85*a*, 85*b* in FIG. 14 between each finger 85. The engagement end 83 of the anti-preset piston 81 is provided with an upwardly extending fingers 87*a*, 87*b* in FIG. 14, which are received within the setting sleeve end slots when the setting sleeve is locked in the running-in position (see FIG. 13). The setting sleeve fingers 85 have a circumferential groove 89 (FIG. 12) cut therein which contains a snap ring 91. The circumscribing member 67 has an internal shoulder 93 which engages the snap ring 91 when the engagement end 83 of the anti-preset piston 81 locks the setting sleeve 59 in the running-in position.

Figure 11:
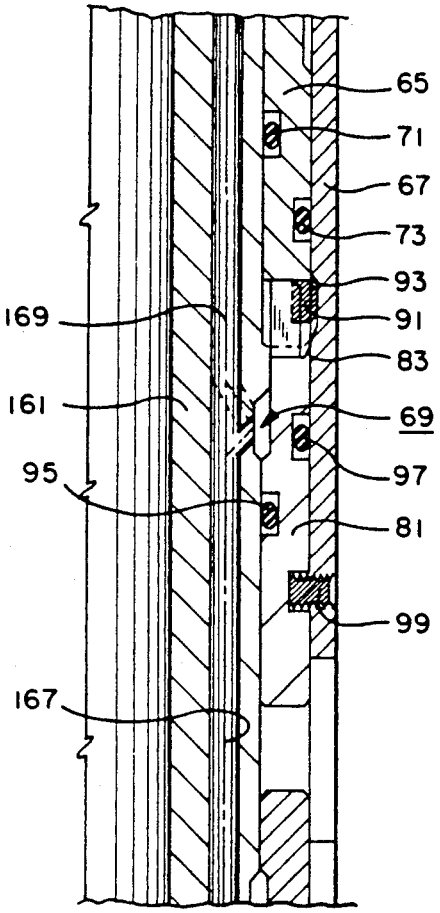
FIG. 11 is an enlarged, quarter-sectional view of the setting chamber of the device showing the anti-preset piston engaged with the setting sleeve.
Figure 12:
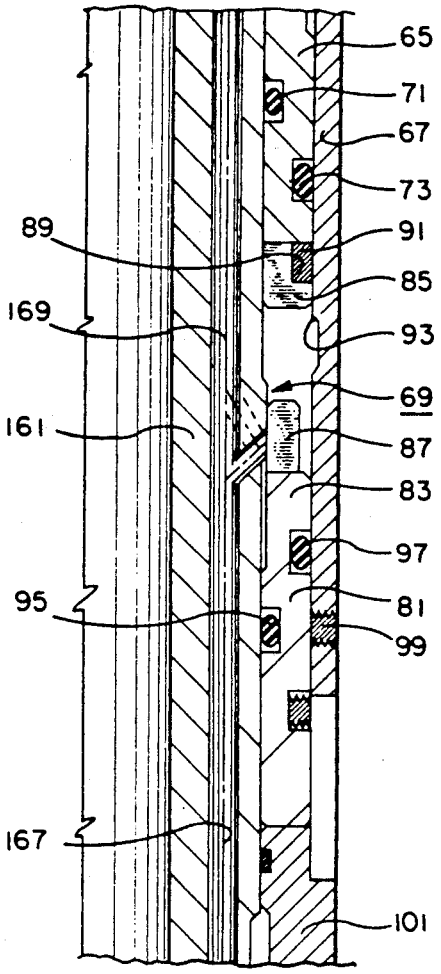
FIG. 12 is a view similar to FIG. 11 showing the disengagement of the setting sleeve during the setting operation.

As shown in FIGS. 11 and 12, the upwardly extending fingers 87 of the anti-preset piston 81 initially underlie the snap ring 91 of the setting sleeve 59 when in the running-in position, whereby the snap ring 91 engages the internal shoulder 93 of the circumscribing member 67. The upwardly extending fingers 87 are axially moveable from beneath the snap ring to a release position which frees the snap ring 91 from the internal shoulder 93 upon the application of hydraulic pressure to the setting chamber 69.

The anti-preset piston 81 has inner and outer O-rings 95, 97 for forming a sliding seal between the circumscribing member 67 and the exterior of the cylindrical hanger body portion 49. Shear means, such as shear pins 99 (FIG. 4) initially fix the position of the anti-preset piston 81 relative to the setting sleeve 59, the shear means being shearable by the application of a predetermined hydraulic pressure to the setting chamber 69 to thereby allow the anti-preset piston 81 to move to the release position shown in FIG. 12.

Figure 5:
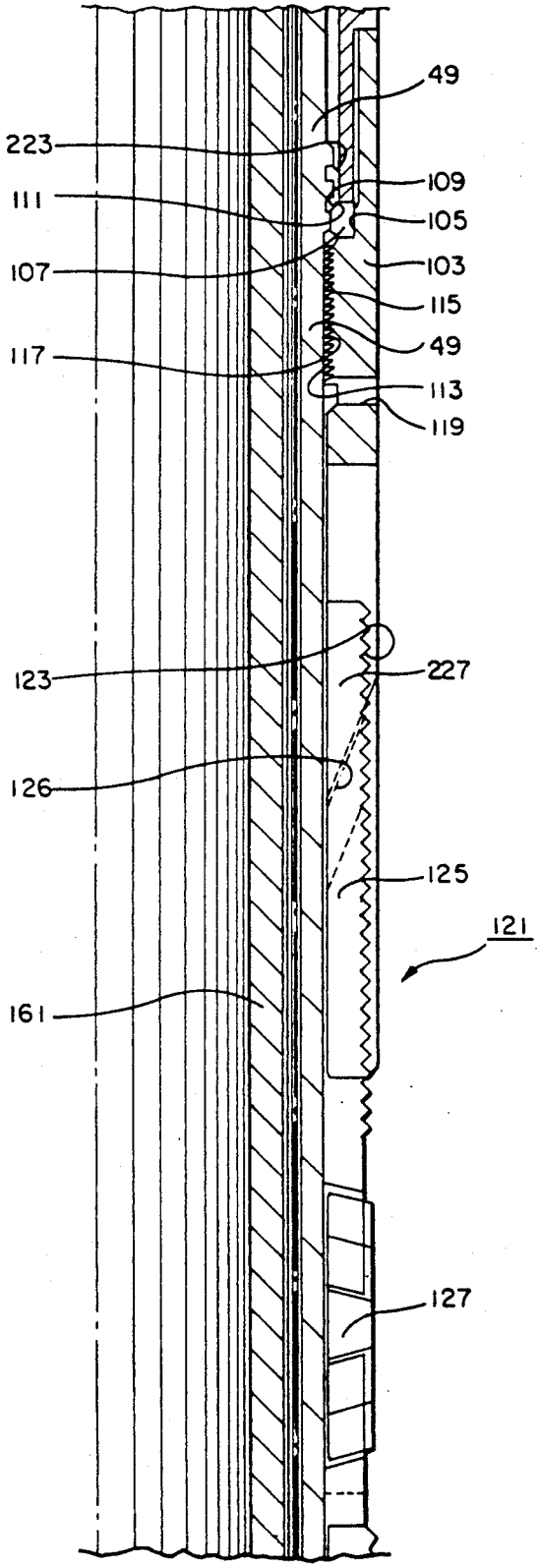
FIG. 5 is a downward continuation of FIG. 4 showing the upper, circumferentially spaced slips carried on the exterior of the hanger body.

Returning to FIG. 4, the circumscribing member 67 is connected to an axially slidable tubular portion 101 of a slip setting body 103. The slip setting body 103 circumscribes the cylindrical hanger body portion 49 and includes an internal groove 105 which contains a support ring 107 (FIG. 5). The support ring 107 includes a support shoulder 109 which engages the mating shoulder 111 provided on the external diameter of the cylindrical hanger body portion 49. The slip setting body 103 also includes an internal wicker surface 113 which engages a body lock ring 115. The body lock ring 115 has an external wicker surface which engages the serrated exterior 117 of the hanger body portion 49. The body lock ring 115 allows downward axial movement of the slip setting body 103 relative to the serrated exterior 117 of the hanger body but prohibits upward axial movement thereof. A vent port 119 communicates the space between the hanger body portion 49 and the exterior of the slip setting body 103.

Figure 6:
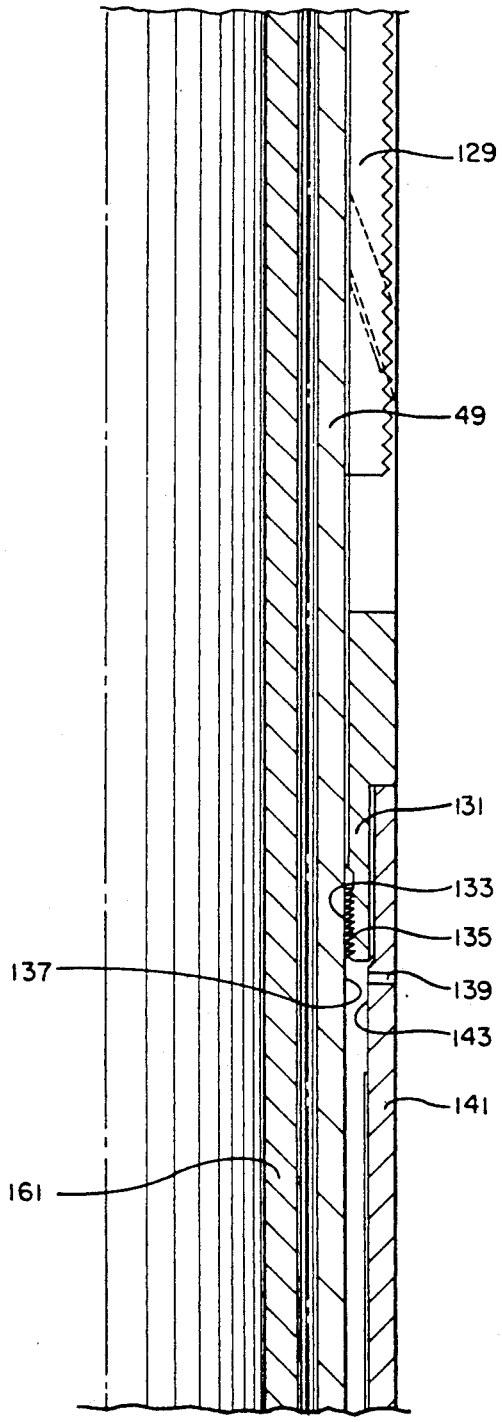
FIG. 6 is a downward continuation of FIG. 5 showing the lower, circumferentially spaced slips carried on the exterior of the hanger body.

As shown in FIGS. 5 and 6, a plurality of circumferentially spaced slips 121 are carried on the exterior of the hanger body 13. The slips have outer gripping surfaces 123 adapted to grip the surrounding well casing. The slips are actuable by axial movement of the anti-preset piston 81 to grip the well casing and support the hanger body 13 within the well casing.

The slip mechanism shown in FIGS. 5 and 6 includes a plurality of circumferentially spaced upper gripping slips 125 which are connected by means of a solid ring 127 with an oppositely arranged set of circumferentially spaced lower slips 129. The particular slip arrangement shown in FIGS. 5 and 6 is described, e.g., in U.S. Pat. No. 4,711,326, issued Dec. 8, 1987, and assigned to the assignee of the present invention, the disclosure of which is hereby incorporated by reference. Such slip gripping mechanisms will be familiar to those skilled in the art and do not form a part of the present invention. Any suitable mechanism can be utilized which allows the gripping slips to move radially outward upon the downward axial movement of the anti-preset piston and slip setting bodies 103.

The slip setting body includes a lower extent 131 (FIG. 6) which includes an internal wicker surface 133 carrying a body lock ring 135. The body lock ring 135 has an external wicker surface which engages a mating serrated surface 137 provided on the exterior of the cylindrical hanger body portion 49. The body lock ring 135 allows the lower extent 131 to move downwardly relative to the body portion 49, but prohibits opposite relative movement. A vent port is provided in the cylindrical sidewall of the circumscribing member 141, the vent port 139 providing communication between an annular space 143 and the exterior of the device. It will also be noted in FIG. 7 that a spaced serrated surface 145 is provided on the exterior of the lower end 17 of the body portion 49 of the hanger body for engaging the body lock ring 135 during subsequent operations.

As shown in FIG. 7, the body portion 49 has an externally threaded region 147 which matingly engages the internally threaded region 149 of a downwardly extending latch collet 151. The latch collet 151 has a plurality of externally threaded collet fingers 153 which are adapted to engage an internal thread profile 155 provided in the downwardly extending cylindrical member 141 to lock the setting force in the packing element and gripping slips.

A release sleeve 157 is located within the internal bore of the hanger body and is provided with a plurality of external support lands 159 which underlie the externally threaded collet fingers 153 in the engaged position shown in FIG. 7 and which are axially shiftable from beneath the externally threaded collet fingers in a release position.

Returning to FIG. 1, an inner mandrel 161 having an upper box connection 163 is located within the internal bore 27 of the hanger body 13. The inner mandrel 161 is spaced-apart from the hanger body 13 to define an annular space 165 (FIG. 2) within the internal bore of the hanger body 13. As shown beginning in FIG. 4 and continuing downwardly therefrom, a hydraulic line 167 is provided for communicating hydraulic pressure to the setting chamber 69. The hydraulic line 167 is located in the annular space 165 between the inner mandrel 161 and the internal bore of the hanger body and is arranged to extend from a point below the circumferentially spaced slips 121 along the longitudinal axis of the hanger body 13 to the setting chamber 69, whereby the packing element and gripping slips can be set by the application of hydraulic pressure from the lower end 17 of the hanger body 13.

Preferably, a second hydraulic line 169 extends within the annular space 165 from the upper end of the hanger body 13 to the setting chamber 69, whereby the packing element and gripping slips can be set by the application of hydraulic pressure from the upper end of the hanger body. The hydraulic lines 167, 169 can be formed, e.g., from continuously extruded stainless steel or Inconel.

Figure 8:
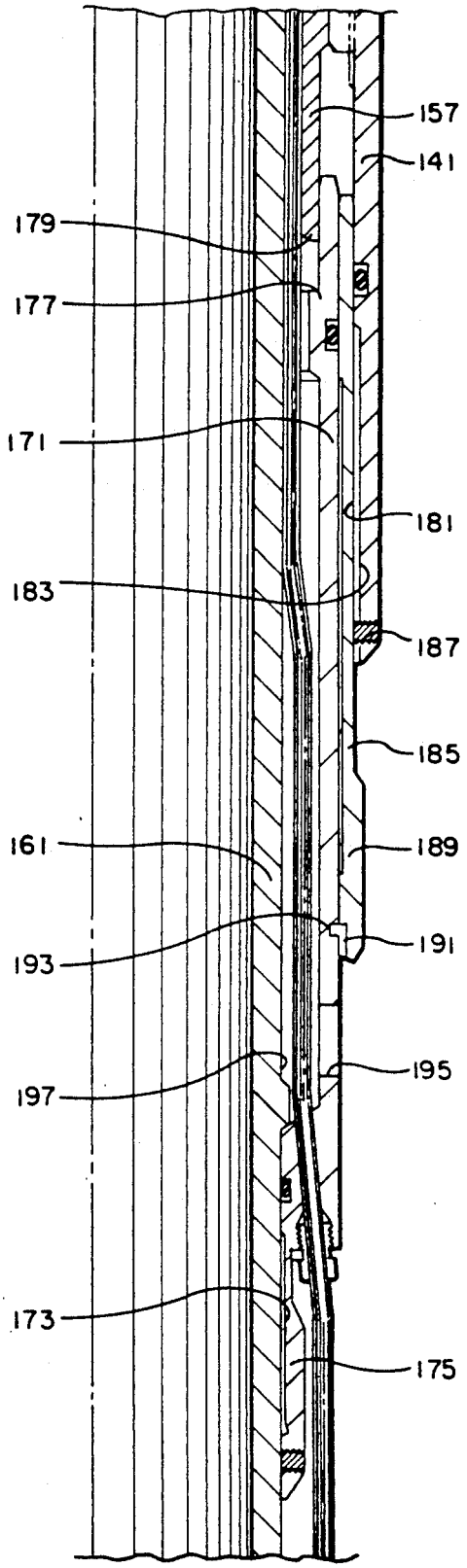
FIG. 8 is a downward continuation of FIG. 7 and shows the actuating sleeve which is used to move the release sleeve during the release operation.

As shown in FIG. 8, the inner mandrel 161 has an externally threaded lower extent 173 which engages the depending portion 175 of an actuating sleeve 171. The actuating sleeve 171 is located about the exterior of the inner mandrel 161 within the interior of the downwardly extending cylindrical member 141 and includes an internal shoulder 177 for contacting the lower most extent 179 of the release sleeve 157 when the inner mandrel 161 is moved upwardly with respect to the outer hanger body.

The downwardly extending cylindrical member 141 has an internally threaded surface 181 which engages the mating externally threaded surface 183 of an inner sleeve 185, the inner sleeve also being connected to the cylindrical member 141 by one or more set screw 187. The lower end 189 of the inner sleeve 185 is provided with an internal recess for receiving a shear ring 191 the shear ring 191 being provided with a frangible extent 193 which is received within a mating groove provided in the actuating sleeve 171.

As shown in FIG. 8, a plurality of ports 195 are provided in the actuating sleeve 171 which communicate the annular space 197 with the exterior of the tool.

The shear ring 191 comprises a first shear means for initially connecting the actuating sleeve 171 to the downwardly extending cylindrical member 141 and its inner sleeve 185. A second shear means, such as shear screws 199 (FIG. 7) are provided for initially connecting the release sleeve 157 to the latch collet 151 and, in turn, to the cylindrical hanger body portion 49. Upward movement of the inner mandrel 161 serves to shear the first and second shear means, to free the release sleeve 157 and move the external support lands 159 from beneath the externally threaded collet fingers 153 to relax the packing element and gripping slips.

Figure 9:
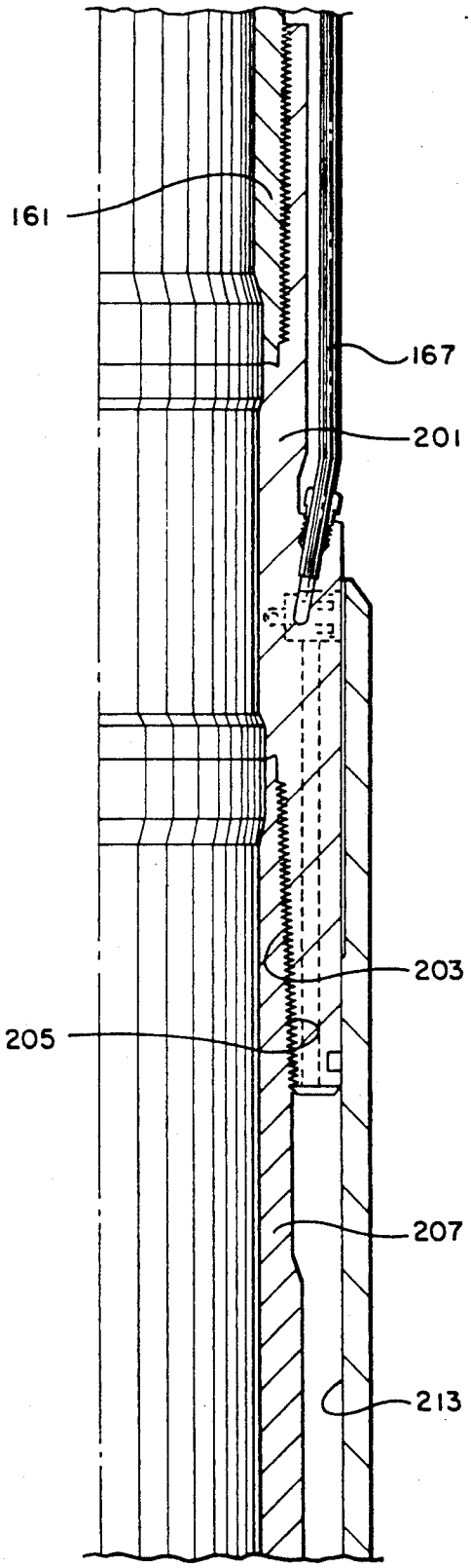
FIGS. 9 is a downward continuation of FIG. 8 and shows the oil filled chamber used to supply hydraulic pressure to the setting chamber to set the packing element.
Figure 10:
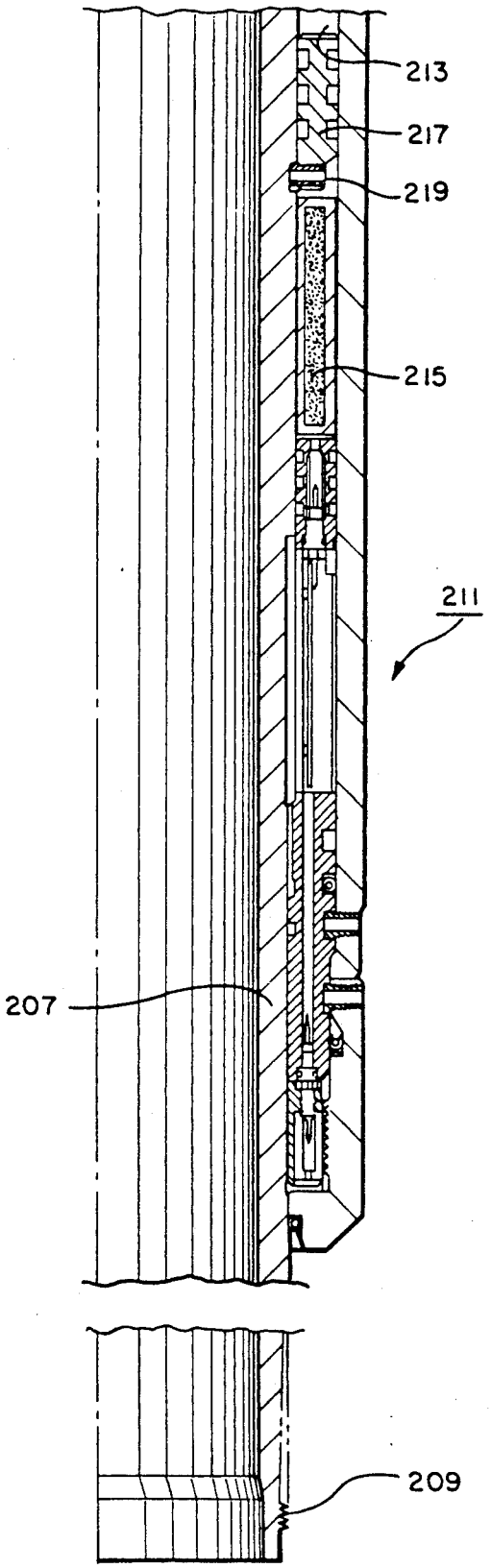
FIG. 10 is a downward continuation of FIG. 9 and shows the actuating mechanism used to supply hydraulic pressure to the setting chamber to set the device.

As shown in FIGS. 9 and 10, the inner mandrel 161 includes a coupling connection 201 which includes an internally threaded extent 203 for engaging the externally threaded upper extent 205 of a tubular sub 207 which makes up the lower end of the inner mandrel. As shown in FIG. 10, the pin end 209 of the tubular sub 207 is externally threaded to engage a mating connecting end of a production string (not shown) supported by the tubing hanger 11 within the cased well bore. The tubular sub 207, in the embodiment of the device shown in FIGS. 9 and 10 supports an actuating mechanism (211 in FIG. 10) which is used to supply a hydraulic setting force to an oil filled chamber 213 arranged in communication with the lower hydraulic line 167. The hydraulic line 167 communicates with the setting chamber 69 for supplying hydraulic fluid to the setting chamber to set the packing element 53 and the gripping slips 121.

The exact actuating mechanism (211 in FIG. 10) illustrated does not form a part of the present invention and is described, for instance, in the co-pending application entitled Subsurface Well Apparatus, filed July 9, 1990, the disclosure of which is hereby incorporated by reference. The actuating control 211 generates an activating voltage in response to external conditions, e.g., significant changes in the stresses existing in the conduit walls to which the device is attached. The activating voltage causes the propellant 215 to be actuated, thereby forcing the piston 217 to shear the pins 219 and drive the piston 217 vertically upward to compress the hydraulic oil located in the oil filled chamber 213. This increase in hydraulic pressure is ultimately transmitted to the setting chamber 69, as previously described.

In operation, the box end 163 of the inner mandrel is used to connect the tubing string leading from the well surface (not shown) to the hanger body 13. The concentric spacing of the inner and outer tubular bodies 19, 163 (FIG. 1) defines an annular flow path 165 which runs the length of the inner mandrel to the flow ports (195 in FIG. 8) whereby a fluid such as natural gas can be injected along the annular flow path from a point above the set packing element 53 and out the ports 195 to the annular space in the surrounding borehole below the set packing element. As will be familiar to those skilled in the art, a pair of safety valves are customarily located above the device (not shown) a tubing safety valve seals off the production and internal tubing while an annular safety valve is used to seal off fluid which is injected down the annular flow path, previously described. As a result, the tubular bodies 19, 163 are fixed relative to one another in the position shown in FIGS. 1 and 2 and do not move relative to one another until the release operation.

The device is run into position within the surrounding well casing with the packing element 53 and gripping slips 121 in the relaxed positions shown in FIGS. 1-6. After lowering the device to the desired depth, the actuating control 211 is actuated to cause the mechanism to force the piston 217 axially upward, thereby compressing the oil in the oil filled chamber 213. Hydraulic pressure is thus supplied through the hydraulic line 167 to the setting chamber 69 (FIG. 4).

An increase in hydraulic pressure in the setting chamber 69 acts upon the anti-preset piston 81 causing the piston 81 to shear the pins 99 and move downwardly as viewed in FIG. 4. This action causes the upwardly extending fingers 87 to be pulled from beneath the snap ring 91 thereby allowing the snap ring 91 to move radially inward within the groove 89 to the release position shown in FIG. 12. In this position, the snap ring 91 no longer engages the internal shoulder 93, whereby the setting sleeve 59 is freed to move in an upward axial direction to compress the packing element 53. Body lock ring 79 (FIG. 4) prohibits the opposite axial travel of the setting sleeve 65 relative to the circumscribing member 67 and locks the setting force in the packing element.

The downward movement of the anti-preset piston 81 and the opposite relative movement between the circumscribing member 67 and the setting sleeve 65 also causes the slip setting body 103 to move downwardly to effect the outward radial movement of the gripping slips 125, 129. During the setting operation, the upper slips 125 and ring 127 cause the lower slips 129 to move axially downward as a unit, whereby the lower slips 129 ride up their respective ramp surfaces. This causes the gripping surfaces to travel radially outward and grip the surrounding well casing. After the lower slips 129 begin to grip the surrounding casing, the upper slips 125 are driven up the ramp surface 126, thereby causing outward radial movement of the upper slips to grip the surrounding casing. The exact setting mechanism of the gripping slips will be familiar to those skilled in the art and is described, for instance, in U.S. Pat. No. 4,711,326, previously referenced.

Movement of the top body lock ring 79 traps the packing element in compression and maintains a fluid tight seal. Movement of the middle body lock ring 115 along the serrated exterior surface 117 of the hanger body portion 49 causes the lock ring to act as a one-way ratchet device which prevents the hanger load from being transferred into the packing element after setting the device. The bottom body lock ring 135 similarly ratchets along the mating serrated surface 145 to maintain the slips in a retracted position during retrieval, as will be explained.

In order to retrieve the device to the well surface, the inner mandrel 161 is pulled upwardly relative to the hanger body 13, thereby shearing the shear ring 191 (FIG. 8) carried at the lower end of the mandrel. This action allows the actuating sleeve 171 to move axially upward, whereby the internal shoulder 177 contacts the lower most extent 179 of the release sleeve 157. Continued upward movement of the inner mandrel relative to the hanger body 13 causes the pins 199 to shear, thereby allowing the release sleeve 157 to move axially upward and to remove the external support lands 159 from beneath the externally threaded collet fingers 153. This allows the collet fingers 153 to flex radially inward, thereby allowing the upward movement of the collet 151 and the hanger body portion 49.

As this action is occurring, a first pick up shoulder 221 (FIG. 4) engages the setting sleeve 59, stretching out the sleeve portion thereof. A second pick up shoulder 223 (FIG. 5) engages the internal shoulder 225 (FIG. 4) of the tubular portion 101, causing the upper cone 227 (FIG. 5) to be pulled from beneath the upper slips 125. This action allows the upper slips 125 and, in turn the lower slips 129 to relax and be retracted radially inward so that the unit is stretched from the top to release the setting mechanism. As shown in FIGS. 6 and 7, the internal wicker surface 133 of the body lock ring 135 engages the spaced serrated surface 145 of the body portion 49 as the body portion moves upwardly to lock the setting components in the stretched-out position. The hanger can then be retrieved to the well surface.

An invention has been provided with several advantages. The pack-off tubing hanger of the invention is simple in design and operation. The device includes a hydraulic setting chamber and hydraulic lines which run from the opposite ends of the device so that the device can be set from above or below the packing element. An internal mandrel runs along the length of the internal bore of the tubing hanger and features metal-to-metal threaded connections which eliminate the necessity of setting ports and seals which can be subject to wear and deterioration. The device can be retrieved in a single step operation by a straight upward pull on the tubing string which shears a shear ring at the bottom of the device connecting the inner mandrel to the hanger body. A seal member is located about the inner mandrel at the upper end of the device in order to reduce the piston area subject to hydraulic pressure from below the packer when the packing element is set.

While the invention has been shown in only one of its forms, it is not thus limited but is susceptible to various changes and modifications without departing from the spirit thereof.

I claim:

1. A pack-off apparatus for sealing between concentric tubular bodies in a subsurface well location, comprising:

a generally cylindrical hanger body having an upper end and a lower end, the hanger body being adapted to be supported in a surrounding well casing, the hanger body having a longitudinal axis and an internal bore;

an annular packing element carried about the hanger body which is radially expandable under axial compression;

a setting sleeve carried about the hanger body, the setting sleeve being axially movable with respect to the packing element for compressing the packing element, the setting sleeve having an upper end adapted to contact the packing element and a lower end, the lower end of the setting sleeve being slidably received within the interior of a circumscribing member which defines a setting chamber on the exterior of the hanger body;

a plurality of circumferentially spaced slips carried on the exterior of the hanger body, the slips having outer gripping surfaces adapted to grip the surrounding well casing, the slips being actuable by axial movement of the setting sleeve to grip the well casing and support the hanger body within the well casing; and wherein a hydraulic line is provided for communicating hydraulic pressure to the setting chamber, the hydraulic line being located within the internal bore of the hanger body and being arranged to extend from a point below the circumferentially spaced slips along the longitudinal axis of the hanger body to the setting chamber, whereby the packing element and gripping slips can be set by the application of hydraulic pressure from the lower end of the hanger body.

2. The pack-off apparatus of claim 1, wherein the hydraulic line extends from the lower end of the hanger body to a point intermediate the gripping slips and the packing element.

3. The pack-off apparatus of claim 2, wherein a second hydraulic line extends from the upper end of the hanger body to the setting chamber, whereby the packing element and gripping slips can be set by the application of hydraulic pressure from the upper end of the hanger body.

4. A pack-off, tubing hanger for use in a tubing string extending from a well surface location to a downhole location within a surrounding subterranean formation lined with a well casing, the tubing hanger comprising:

a generally cylindrical hanger body having an upper end and a lower end, the hanger body being adapted to be supported in the surrounding well casing, the hanger body having a longitudinal axis, cylindrical sidewall portions and an internal bore;

an inner mandrel located within the internal bore of the hanger body, the inner mandrel being spaced-apart from the hanger body to define an annular space within the internal bore of the hanger body;

an annular packing element carried about the hanger body which is radially expandable under axial compression;

a setting sleeve carried about the hanger body, the setting sleeve being axially movable with respect to the packing element for compressing the packing element, the setting sleeve having an upper end adapted to contact the packing element and a lower end, the lower end of the setting sleeve being slidably received within the interior of a circumscribing member which defines a setting chamber on the exterior of the hanger body;

a plurality of circumferentially spaced slips carried by a slip assembly on the exterior of the hanger body, the slips having outer gripping surfaces adapted to grip the surrounding well casing, the slips being actuable by axial movement of the setting sleeve to grip the well casing and support the hanger body within the well casing; and wherein a hydraulic line is provided for communicating hydraulic pressure to the setting chamber, the hydraulic line being located within the annular space provided between the internal bore of the hanger body and the exterior of the internal mandrel and being arranged to extend from a point below the circumferentially spaced slips along the longitudinal axis of the hanger body to the setting chamber, whereby the packing element and gripping slips can be set by the application of hydraulic pressure from the lower end of the hanger body.

5. The pack-off tubing hanger of claim 4, wherein a second hydraulic line extends within the annular space from the upper end of the hanger body to the setting chamber, whereby the packing element and gripping slips can be set by the application of hydraulic pressure from the upper end of the hanger body.

6. The pack-off tubing hanger of claim 5, wherein the slip assembly includes a downwardly extending cylindrical member having an internal thread profile, and wherein the hanger body is provided with a downwardly extending latch collet, the latch collet having a plurality of externally threaded collet fingers which are adapted to engage the internal thread profile provided in the downwardly extending cylindrical member to lock the setting force in the packing element and gripping slips, and wherein a release sleeve is located in the annular space between the inner mandrel and the hanger body, the release sleeve being provided with a plurality of external support lands which underlie the externally threaded collet fingers in the engaged position and which are axially shiftable from beneath the externally threaded collet fingers in a release position.

7. The pack off tubing hanger of claim 6, further comprising an actuating sleeve carried by the inner mandrel, the actuating sleeve being axially slidable in the direction of the release sleeve upon upward movement of the inner mandrel;

first shear means initially connecting the actuating sleeve to the downwardly extending cylindrical member; and second shear means initially connecting the release sleeve to the surrounding hanger body, upward movement of the inner mandrel serving to shear the first and second shear means to free the release sleeve and move the external support lands from beneath the externally threaded collet fingers to relax the packing element and gripping slips.

8. The pack-off tubing hanger of claim 7, wherein the first shear means is a shear ring located between the exterior of the inner mandrel and the interior of the downwardly extending cylindrical member.

9. The pack-off tubing hanger of claim 8, where the second shear means is a plurality of shear pins connecting the release sleeve to the hanger body.

10. A pack-off, tubing hanger for use in a tubing string extending from a well surface location to a downhole location within a surrounding subterranean formation lined with a well casing, the tubing hanger comprising:

a generally cylindrical hanger body having an upper end and a lower end, a longitudinal axis and an internal bore, the hanger body being adapted to be supported in the surrounding well casing, and wherein the hanger body includes an upper cylindrical extent having a region of greater relative external diameter which is connected to a region of lesser relative external diameter, the region of lesser relative external diameter being received within the internal bore of the hanger body in slip-fit fashion;

a seal member located between the region of lesser relative diameter of the upper cylindrical extent and the internal bore of the hanger body;

an inner mandrel located within the internal bore of the hanger body, the inner mandrel being spaced-apart from the hanger body to define an annular space within the internal bore of the hanger body;

an annular packing element carried about the hanger body which is radially expandable under axial compression;

a setting sleeve carried about the hanger body, the setting sleeve being axially movable with respect to the packing element for compressing the packing element, the setting sleeve having an upper end adapted to contact the packing element and a lower end, the lower end of the setting sleeve being slidably received within the interior of a circumscribing member which defines a setting chamber on the exterior of the hanger body;

a plurality of circumferentially spaced slips carried by a slip assembly on the exterior of the hanger body, the slips having outer gripping surfaces adapted to grip the surrounding well casing, the slips being actuable by axial movement of the setting sleeve to grip the well casing and support the hanger body within the well casing; and wherein a hydraulic line is provided for communicating hydraulic pressure to the setting chamber, the hydraulic line being located within the annular space provided between the internal bore of the hanger body and the exterior of the internal mandrel and being arranged to extend from a point below the circumferentially spaced slips along the longitudinal axis of the hanger body to the setting chamber, whereby the packing element and gripping slips can be set by the application of hydraulic pressure from the lower end of the hanger body.

11. The pack-off tubing hanger of claim 10, wherein the packing element is carried about the hanger body at a first radial position with respect to the longitudinal axis of the hanger body and wherein the location of the seal member is radially inward or the packing element in order to reduce the hydraulic area of the packing element.

* * * * *